US011311091B1

(12) United States Patent
Petry

(10) Patent No.: US 11,311,091 B1
(45) Date of Patent: Apr. 26, 2022

(54) BABY-SAFE FINGERNAIL AND TOENAIL NIPPERS

(71) Applicant: Tessa Lee Petry, Tulsa, OK (US)

(72) Inventor: Tessa Lee Petry, Tulsa, OK (US)

( * ) Notice: Subject to any disclaimer, the term of this patent is extended or adjusted under 35 U.S.C. 154(b) by 0 days.

(21) Appl. No.: 17/394,244

(22) Filed: Aug. 4, 2021

(51) Int. Cl.
*A45D 29/02* (2006.01)

(52) U.S. Cl.
CPC ..... *A45D 29/02* (2013.01)

(58) Field of Classification Search
None
See application file for complete search history.

(56) References Cited

U.S. PATENT DOCUMENTS

| | | | | | |
|---|---|---|---|---|---|
| 327,065 | A * | 9/1885 | Burton | A45D 29/02 | 30/28 |
| 2,028,558 | A * | 1/1936 | Nietzel | A45D 29/02 | 30/28 |
| 2,392,118 | A * | 1/1946 | Cacarillo | B25B 7/08 | 30/261 |
| 2,507,345 | A * | 5/1950 | Meesook | A45D 29/023 | 30/28 |
| 2,515,852 | A | 7/1950 | Bilsky | | |
| 2,837,821 | A | 6/1958 | David | | |
| 2,839,827 | A * | 6/1958 | David | A45D 29/023 | 30/28 |
| 3,180,025 | A | 4/1965 | Tsunemi | | |
| 3,986,257 | A | 10/1976 | Kiura | | |
| 4,564,034 | A | 1/1986 | Mackel | | |
| 5,101,563 | A * | 4/1992 | d'Orgelys | A45D 29/02 | 30/262 |
| 5,711,075 | A | 1/1998 | Wolf | | |
| 5,881,461 | A * | 3/1999 | Schwartz | A45D 29/023 | 30/28 |
| 5,964,033 | A | 10/1999 | Wolf | | |
| D533,307 | S | 12/2006 | Ross | | |
| 10,076,173 | B1 | 9/2018 | Kaidi et al. | | |
| D838,044 | S | 1/2019 | Jackson | | |
| 10,383,424 | B2 | 8/2019 | Kim | | |
| D914,984 | S | 3/2021 | Zon | | |
| D919,889 | S | 5/2021 | Park | | |
| 2009/0241342 | A1* | 10/2009 | Habib | B26B 17/00 | 30/28 |
| 2014/0202003 | A1* | 7/2014 | Ishida | A45D 29/02 | 30/28 |
| 2014/0325846 | A1 | 11/2014 | Hussain | | |

* cited by examiner

*Primary Examiner* — Hwei-Siu C Payer
(74) *Attorney, Agent, or Firm* — Head, Johnson, Kachigian & Wilkinson, PC

(57) ABSTRACT

The invention relates to baby-safe fingernail and toenail nippers comprising: two cutting arms pivotably connected, each with a handle portion, a cutting-edge portion, and a pivot point therebetween; and a curved cutting blade in each cutting-edge portion angled such that in a pivotably closed position the cutting blades of each cutting arm meet flush against one another and are visible to the user; wherein each end of the cutting-edge portions extends beyond and rounds back to the cutting blade thus creating a wide "V" shape when in the closed position.

9 Claims, 4 Drawing Sheets

BABY-SAFE FINGERNAIL AND TOENAIL NIPPERS

BACKGROUND OF THE INVENTION

Cross Reference

Not Applicable.

FIELD OF THE INVENTION

This invention relates generally to fingernail and toenail nippers designed to be safe for use on infants, children, and persons having certain disabilities that would inhibit their ability to trim their own fingernails and toenails.

DESCRIPTION OF THE RELATED ART

Trimming fingernails and toenails is a necessary part of human hygiene. It is of particular importance to keep the fingernails of infants and children short. When trimming a child's nails with currently available devices, the parent's line of sight is perpendicular to the blades of the device. Consequently, the parent or caretaker cannot see the lower blade, and must instead judge the proximity of the lower blade to the child's finger or toe. Frequently, the parent or caretaker misjudges that proximity, and cuts the child's finger or toe. Infants and children who have been cut while having their nails trimmed tend to fear and resist subsequent nail trimming, which increases the risk of further cuts. So far, the market has not produced a tool which enables a parent or caretaker to safely trim an infant or child's nails.

The invention as described herein repositions the angle of the blades such that the parent or caretaker can see both blades clearly when trimming a child's nails. Thus, the parent or caretaker can see exactly what portion of the child's nail will be trimmed, drastically reducing the chances of injury.

Further, the invention does not have sharp points and can be used safely even if a child happens to move in such a way that the child touches the tip of the device.

Accordingly, parents and caregivers would benefit from a baby-safe fingernail and toenail nipper having a very high level of visibility on both sides of the cutting blades which would drastically reduce the likelihood of injury.

Further, parents and caregivers would benefit from a baby-safe fingernail and toenail nipper having soft edges everywhere but at the cutting blades for additional enhanced safety.

SUMMARY OF THE INVENTION

In general, in a first aspect, the invention relates to baby-safe fingernail and toenail nippers comprising: two cutting arms pivotably connected, each with a handle portion, a cutting portion having two ends, and a pivot point therebetween; and a blade, in each cutting portion, having a curved cutting edge aligned such that in a pivotably closed position the cutting edges of each cutting arm meet flush against one another; wherein each end of the cutting portions extends beyond and rounds back to the cutting edge.

The cutting portion may be positioned such that the blade protrudes outwardly from the pivot point.

Each edge of the nippers except the cutting edges may be filleted such that there are no sharp corners.

Each cutting portion of the nippers may be angled to create a wide "V" shape.

The cutting portion may be tapered in thickness down towards the cutting edge such that the cutting edge is thinner than the rest of the cutting portion.

The nippers may further comprise an embedded spring.

The embedded spring may push the handle portions pivotably away from one another.

The handle portions may further comprise a soft covering over at least a portion thereof.

The soft covering may be made of rubber.

The cutting edges may be spaced apart from and not directly abut the pivot point.

The length of the cutting blade may be parallel to the length of the cutting arm.

The length of the cutting blade may be perpendicular to the length of the cutting arm.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
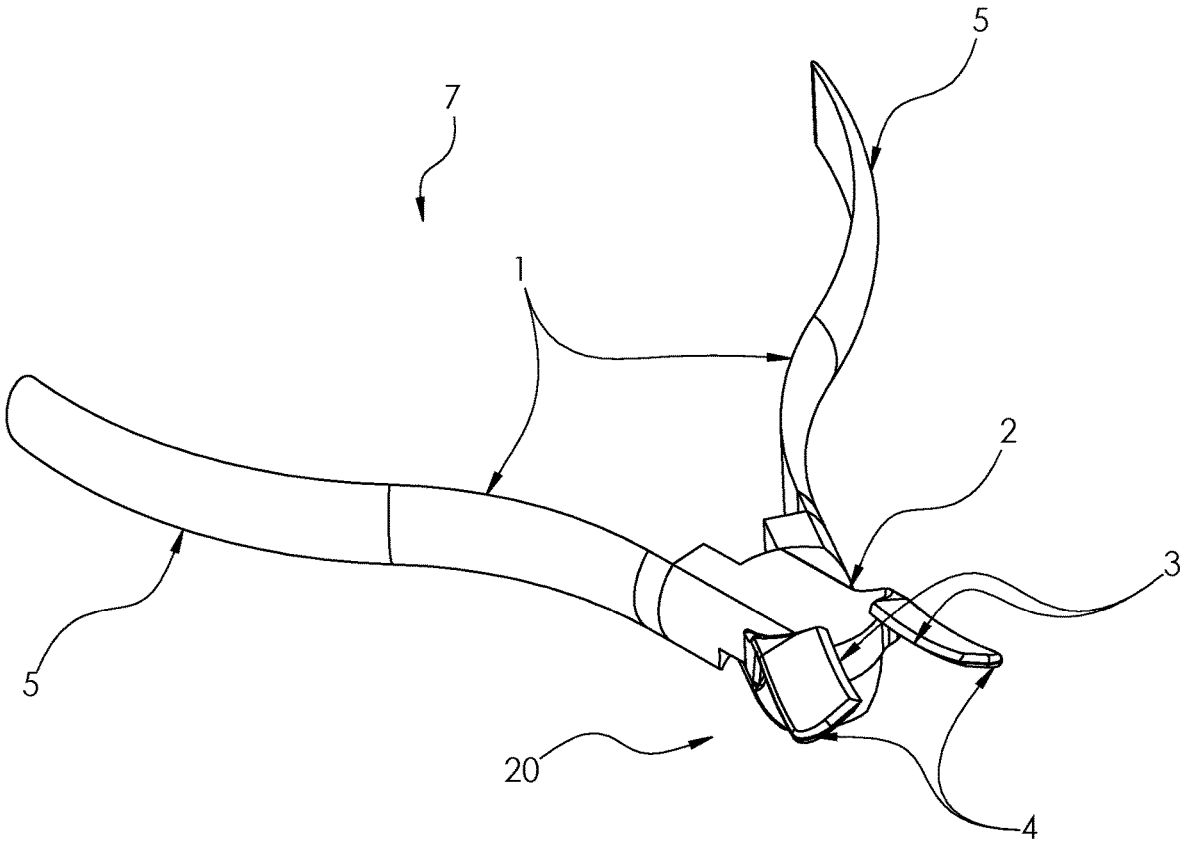
FIG. 1 shows a perspective view of one embodiment of the claimed invention in an open position.

Describing the figures in detail, FIG. 1 is a perspective view of one embodiment of the baby-safe fingernail and toenail nipper in an open position. The nipper 7 comprises two cutting arms one pivotably connected to the other. The cutting arms may have a handle portion 5 at one end, a cutting portion 20 at the other end, and a pivot point 2 about which the cutting arms 1 may rotate in order to change between open and closed positions.

In the open position, the handle portions 5 may be positioned apart from one another such that the cutting edges 3 of the blades 6 are pivotably positioned apart from one another as seen in FIG. 1.

In the closed position, the handle portions 5 may be positioned closer to one another such that the cutting edges 3 of the blades 6 are pivotably positioned up against one another so that they meet flush against one another thereby cutting a fingernail or toenail which may be disposed therebetween.

As seen in FIG. 1, the cutting edges 3 of the blades 6 may be curved to fit the contour of a fingernail or toenail. Such curvature reduces the number of cuts necessary to provide a rounded, smooth end of a cut fingernail or toenail.

Describing each cutting arm in detail, the end of the cutting arm at the end of the cutting portion 20 may be a rounded end 4. More specifically, the cutting portion 20 may extend slightly beyond the cutting edge 3 of the blade 6 such that the rounded end 4 rounds back to the end 8 of the cutting edge 3. Further, the blade may be tapered in thickness down towards the cutting edge 3 such that the cutting edge 3 is thinner than the rest of the cutting portion 20.

The other end of the cutting portion may round back to the other end 9 of the cutting edge 3 of the blade 6. This rounding allows for the cutting edge 3 of the blade 6 to be set apart from the pivot point 2 to increase visibility of the cutting edge 3 from all angles. Each end of the cutting portion 20 rounding back to the ends 8, 9 of the cutting edges 3 creates wide "V" shapes at the ends of the blades 6 when in the closed position with the bottom point of each "V" shape being the ends 8, 9 of the cutting edges 3. These two "V" shapes are shown best in the main drawing of FIG. 3.

Additionally, the cutting portions 20 may be angled from Plane B such that the cutting portions 20 themselves create another wide "V" shape when in the closed position. This feature is shown best in Detail C. Designed in this way, the user's visibility of the top and bottom of the edge of the fingernail or toenail being cut is maximized without compromising the user's view of the nail on the other side of the cutting blades 6. Furthermore, this design allows for the cutting edges 3 to cut the nail closer to the finger without compromising visibility.

In the preferred embodiment shown in the figures, the length of the cutting blades 6 run parallel to the length of the cutting arms 1. However, the length of the cutting blades 6 may be at an angle from the length of the cutting arms 1 and may even be perpendicular to the length of the cutting arms 1 so long as the user's visibility of both sides of the cutting blades 6 is not compromised. The length of the cutting blades 6 may be curved outwardly.

At least a portion of the handle portions may be covered in a soft material such as rubber. The soft rubber coating may act as a comfort grip to improve the comfort of the user.

The two cutting arms may be spring loaded so that the nippers remain in the open position unless they are actively being squeezed by a user to the closed position. Once in a closed position, the spring load assists the user in returning the nippers to the open position. Optionally, the spring may be embedded inside the cutting arms 1 and the pivot point 2.

Figure 2:
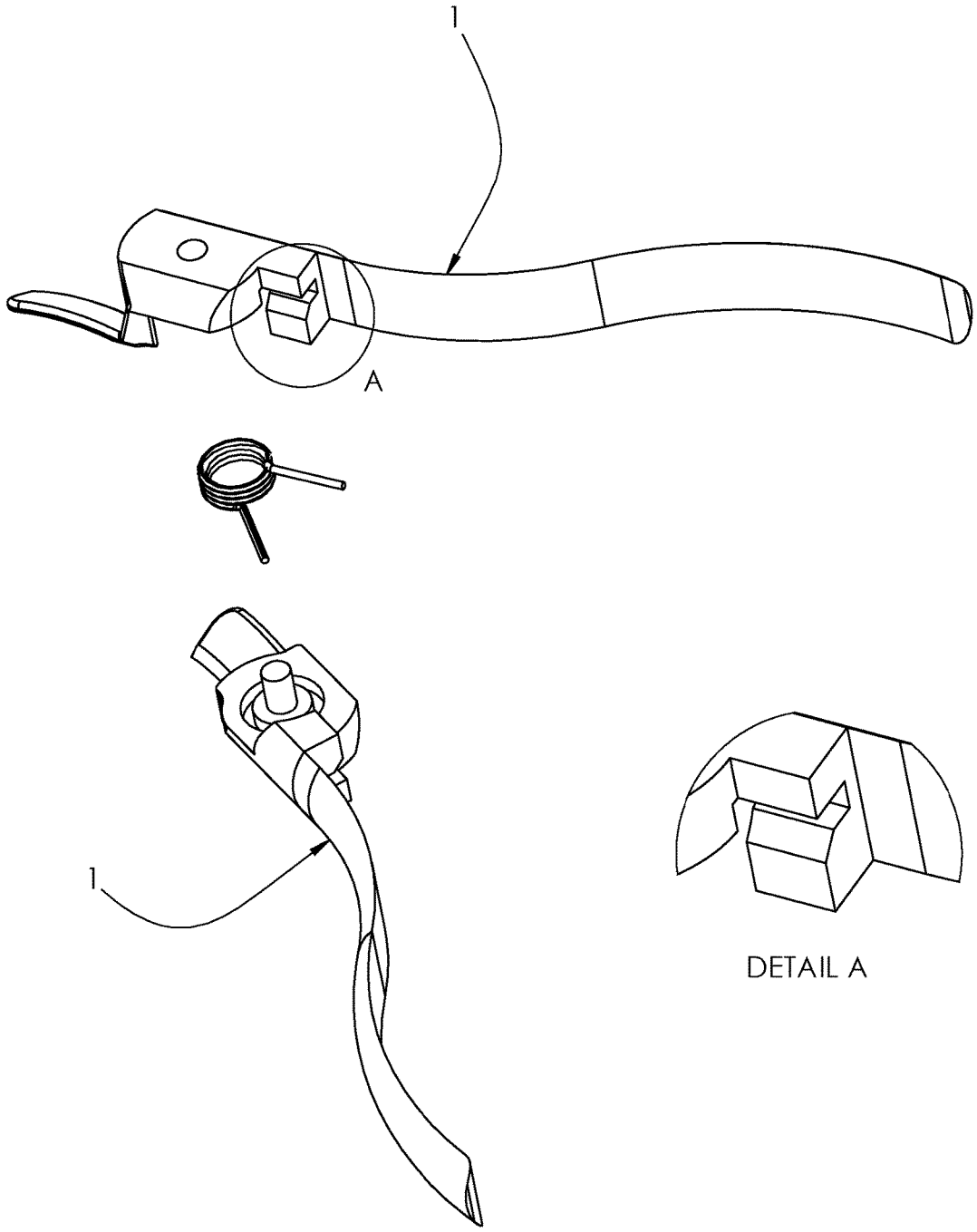
FIG. 2 shows an exploded view of one embodiment of the claimed invention; Detail A shows a recess for an embedded spring.

FIG. 2 shows an exploded view of one embodiment of the claimed invention. In particular, FIG. 2 shows that the nipper may further comprise a spring, and the spring may be embedded within the cutting arms and/or the pivot point.

Figure 3:
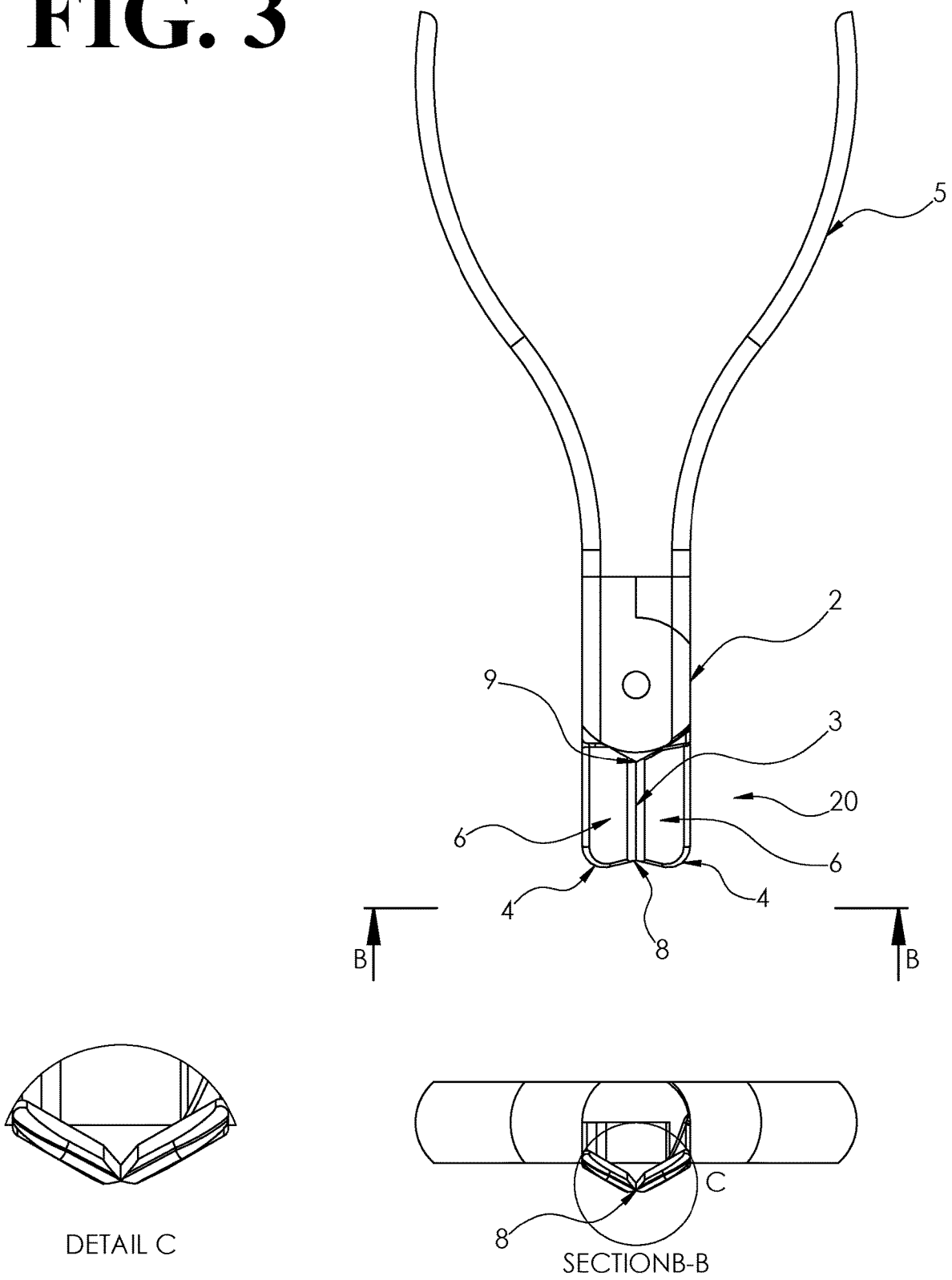
FIG. 3 shows a bottom view of one embodiment of the claimed invention; Section B-B shows a view of the device in FIG. 3 taken along Plane B; Detail C shows a close-up view of the cutting head as shown in Section B-B.

FIG. 3 shows a bottom view of one embodiment of the claimed invention; Section B-B shows a view of the device in FIG. 3 taken along Plane B; Detail C shows a close-up view of the cutting head in the "V" shape as shown in Section B-B.

Figure 4:
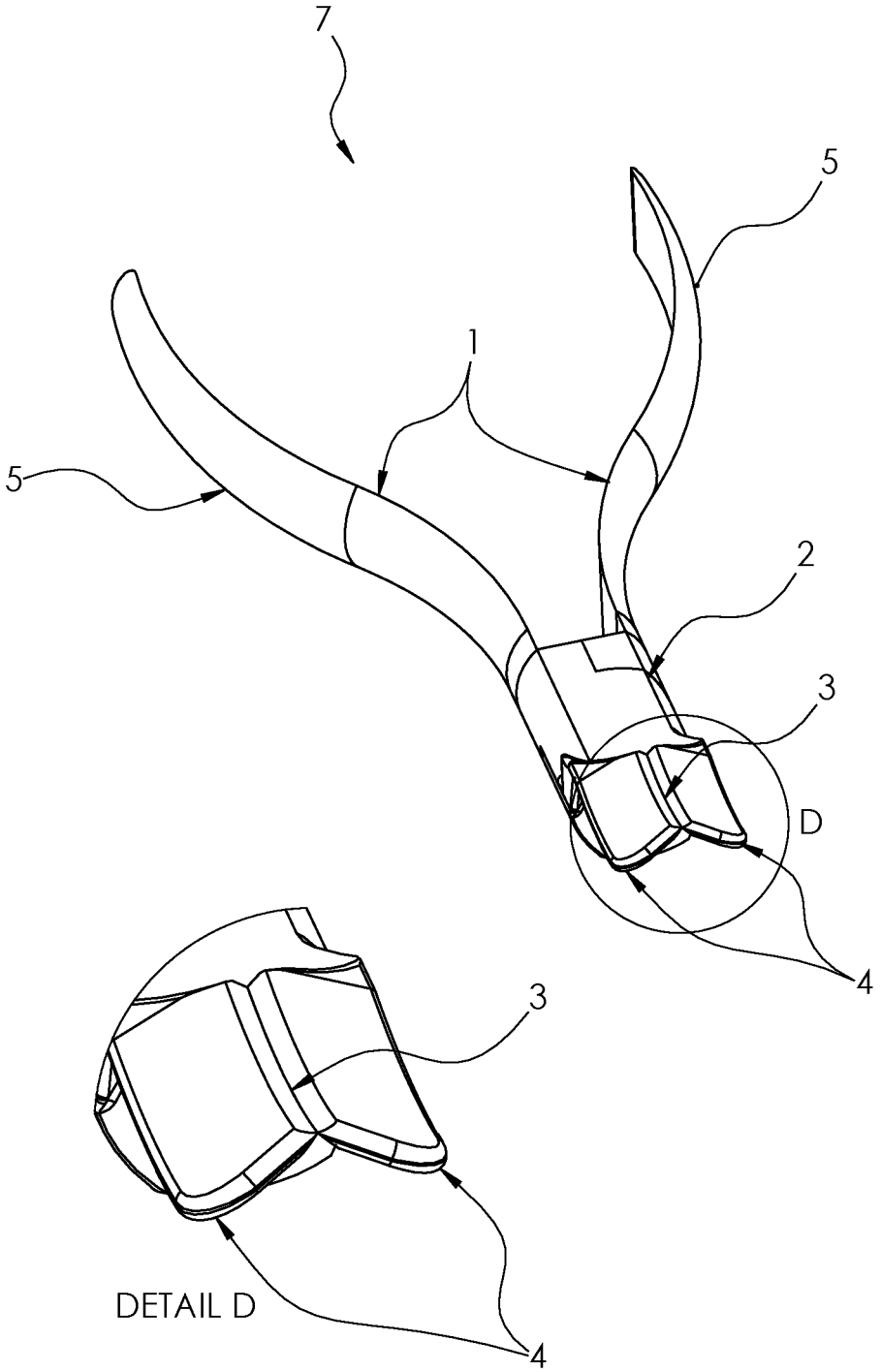
FIG. 4 shows a perspective view of one embodiment of the claimed invention in a closed position; Detail D shows a close of perspective view of the cutting head as shown in FIG. 4.

FIG. 4 shows a perspective view of one embodiment of the claimed invention in the closed position; Detail D shows a close of perspective view of the cutting head as shown in FIG. 4.

Whereas, the devices and methods have been described in relation to the drawings and claims, it should be understood that other and further modifications, apart from those shown or suggested herein, may be made within the spirit and scope of this invention.

What is claimed:

1. A baby-safe fingernail and toenail nipper comprising:

two cutting arms pivotably connected, each with a handle portion, a cutting portion having a first end and a second end, and a pivot point the handle portion and the cutting portion; and a blade, in each cutting portion, having a curved cutting edge wherein the curved cutting edges are aligned such that in a pivotably closed position the curved cutting edges of meet flush against each other;

wherein the first end and the second end of each cutting portion extend beyond and round back to the curved cutting edge such that the first ends of each cutting portion create a wide "V" shape when in the closed position and the second ends of each cutting portion create a wide "V" shape when in the closed position.

2. The baby-safe fingernail and toenail nipper of claim 1 wherein each cutting portion is positioned such that its respective blade protrudes outwardly and each cutting portion is tapered in thickness down towards its respective curved cutting edge such that each curved cutting edge is thinner than the rest of each cutting portion.

3. The baby-safe fingernail and toenail nipper of claim 1 wherein all edges of the nipper except the curved cutting edges are filleted such that there are no sharp corners.

4. The baby-safe fingernail and toenail nipper of claim 1 wherein the nipper further comprises an embedded spring.

5. The baby-safe fingernail and toenail nipper of claim 4 wherein the embedded spring pushes the handle portions pivotably away from each other.

6. The baby-safe fingernail and toenail nipper of claim 1 wherein the handle portions further comprise a soft covering over at least a portion thereof.

7. The baby-safe fingernail and toenail nipper of claim 6 wherein said soft covering is made of rubber.

8. The baby-safe fingernail and toenail nipper of claim 1 wherein each curved cutting edge is spaced apart from and does not directly abut the pivot point.

9. The baby-safe fingernail and toenail nipper of claim 1 wherein the length of each cutting portion is parallel to the length of its respective cutting arm.

* * * * *